United States Patent [19]

Ettlinger et al.

[11] Patent Number: 4,815,394

[45] Date of Patent: Mar. 28, 1989

[54] ADJUSTABLE RACK OF SHELVES

[75] Inventors: Ralph Ettlinger, Annapolis, Md.; Irwin Kulbersh, Skokie, Ill.

[73] Assignee: Amco Corporation, Chicago, Ill.

[21] Appl. No.: 88,676

[22] Filed: Aug. 24, 1987

Related U.S. Application Data

[63] Continuation-in-part of Ser. No. 863,954, May 16, 1986, Pat. No. 4,754,712, which is a continuation-in-part of Ser. No. 835,434, Mar. 3, 1986, abandoned, which is a continuation-in-part of Ser. No. 611,493, May 17, 1984, abandoned.

[51] Int. Cl.[4] ..... A47B 3/00

[52] U.S. Cl. ..... 108/111; 108/144; 108/901

[58] Field of Search ..... 108/111, 110, 144, 107, 108/901, 50; 211/186, 187

[56] References Cited

U.S. PATENT DOCUMENTS

| | | | |
|---|---|---|---|
| 2,840,433 | 6/1958 | Richard et al. . | |
| 3,065,860 | 11/1962 | Swanson . | |
| 3,269,338 | 8/1966 | Shewell | 108/144 |
| 3,313,674 | 4/1967 | Mathews . | |
| 3,331,646 | 7/1967 | Peters . | |
| 3,401,996 | 9/1968 | Rembold et al. . | |
| 3,424,111 | 1/1969 | Maslow | 108/144 |
| 3,454,168 | 7/1969 | Cahn . | |
| 3,467,741 | 9/1969 | Kesling . | |
| 3,469,711 | 9/1969 | Swaneck et al. . | |
| 3,512,652 | 5/1970 | Armstrong . | |
| 3,598,463 | 8/1971 | Kesling | 312/214 |
| 3,604,369 | 9/1971 | Maslow | 108/144 |
| 3,664,274 | 5/1972 | Bustos | 108/144 |
| 3,675,598 | 7/1972 | Kesilman et al. | 108/144 |
| 3,690,744 | 9/1972 | Squire | 312/351 |
| 3,710,733 | 1/1973 | Story | 108/51 |
| 3,765,343 | 10/1973 | Ettlinger et al. | 108/144 X |
| 3,778,949 | 12/1973 | Hellerich | 52/309 |
| 3,832,955 | 9/1974 | Pottinger et al. | 108/51 |
| 3,845,864 | 11/1974 | Heinrich | 211/153 |
| 3,880,092 | 4/1975 | Seeber et al. | 108/901 X |
| 3,912,085 | 10/1975 | Cooke et al. | 211/153 |
| 3,964,404 | 6/1976 | Mueller et al. | 108/144 |
| 3,983,205 | 9/1976 | Barrett | 264/254 |
| 4,067,530 | 1/1978 | Overman | 248/235 |
| 4,079,678 | 3/1978 | Champagne | 108/144 X |
| 4,094,256 | 6/1978 | Holper et al. | 108/50 |
| 4,138,953 | 2/1979 | Tashman | 108/144 |
| 4,142,766 | 3/1979 | Swerbinsky | 312/214 |
| 4,189,877 | 2/1980 | Jentoft et al. . | |
| 4,285,902 | 8/1981 | Braverman | 264/229 |
| 4,397,247 | 8/1983 | Lemelson | 108/901 X |
| 4,467,927 | 8/1984 | Nathan | 108/111 X |
| 4,535,703 | 8/1985 | Henriott et al. | 108/50 |
| 4,595,107 | 6/1986 | Welsch | 108/144 X |

*Primary Examiner*—Kenneth J. Dorner
*Assistant Examiner*—José V. Chen
*Attorney, Agent, or Firm*—Laff, Whitesel, Conte & Saret

[57] ABSTRACT

An all plastic shelf is part of a shelving system and is provided for uses where metal shelves might rust or corrode, especially if attacked by hostile chemicals. The underside of the plastic shelf has a channel formed around the periphery thereof. A welded metal frame fits into the channel, with either the width of the frame or a cover plate substantially covering the channel in order to prevent an entry of foreign matter therein. Sockets are formed in the corners of the frame to receive corner posts for supporting the shelf. These sockets fit into corner sockets which are molded into the metal frame.

22 Claims, 2 Drawing Sheets

ADJUSTABLE RACK OF SHELVES

This is a continuation-in-part of Ser. No. 06/863,954, filed May 16, 1986 now U.S. Pat. No. 4,754,712, which was a continuation-in-part of Ser. No. 06/835,434, filed March 3, 1986 now abandoned, which was, in turn, a continuation-in-part of Ser. No. 06/611,493, filed May 17, 1984 now abandoned.

This invention relates to racks of adjustable shelves and, more particularly, to improved shelving which meets special environmental needs where metals may rust, corrode, or the like, to spoil food or otherwise pose a health hazard.

Adjustable shelving systems (collectively and generically called "shelves" herein) are known in the art. Such shelves have many advantages in that, among other things, they enable a maximization of the use of costly storage space. Such shelving is also easily adapted to accommodate and support a great variety of product sizes, thus enabling a great flexibility as storage requirements change.

An adjustable shelving system has been described in U.S. Pat. Nos. 3,424,111 and 3,523,508. This system makes use of shelf members, circular corner shelf supports, circular corner posts with graduated recesses and two-piece, semi-circular post supports for holding the shelf support and corner post in place. More particularly, the shelf supports are preferably metal and are comprised of two separate pieces which are wrapped around the corner post and snapped into place. Thus, in order to adjust the height of the shelf, the shelf supports must be detached from the shelf and moved. If one portion of the shelf support is lost or broken, the shelving is useless until another shelf support is obtained.

The shelves may be used to store many different things including food, medicine, and other things which are impacted by or have an impact upon both the environment and health. When human life or health are involved, it becomes especially important to prevent contamination. Shelves must be completely cleanable, must not deteriorate, and must not create health hazards. For example, shelves must not rust or corrode which could produce toxic chemical reactions. Moreover, the shelves should not be attacked by chemical substances which may be spilled on them.

Stainless steel is a material which fits most of the needs for shelves of the described type. Such shelves are strong enough and rigid enough to meet the various types of storage requirements for which adjustable shelving is often used. However, stainless steel is very expensive, as compared to other materials, and sometimes there could be other practical reasons for not selecting it. Galvanized steel resists rust, but it is attacked by galvanic currents which may strip away the zinc coating. Plastic coated iron is also satisfactory under many conditions. However, any coated material (galvanized, painted, dipped, etc.) is subject to nicks, scratches, and the like, which exposes the underlying base metal to attack, rust, corrosion, or the like.

Although shelves made from plastic are lightweight, relatively easy to clean and resistant to rust and attack by chemical substances, such shelves are not as strong as metal shelving and, therefore, often not strong enough to meet different storage requirements. Such plastic shelves are not individually strong enough to support heavy loads and when assembled into a unit of several shelves do not provide a rigid and stable system.

Accordingly, an object of this invention is to provide new and improved racks of adjustable shelves which are resistant to rust and attack by chemical substances, but which are strong enough to meet various storage requirements. A more particular object is to provide a plastic shelf which is reinforced with metal members or a metal frame and which will resist corrosion and attack by chemical substances and provide mechanical strength comparable to the strength of iron and steel. A further object is to provide a new and improved lightweight rack of shelves made from plastic and reinforced with metal members or a metal frame to provide strength comparable to steel shelving and which is more economical than stainless steel shelving.

In keeping with one aspect of this invention, an adjustable rack of shelves comprises at least one shelf attached to at least one vertical post by placing the post through a corner socket on the shelf. The shelves are made of plastic with an underside peripheral channel for receiving metal members or a metal frame. Since the channel opens to the underside of the shelves, nothing resting on the shelves can reach the metal members or frame and no rust or corrosion from the metal can reach the upper surface of the shelves. A rustproof cover may be provided for the channel to further protect the metal.

The above mentioned and other features of this invention and the manner of obtaining them will become more apparent and the invention itself will be best understood by reference to the following description of an embodiment of the invention taken in conjunction with the accompanying drawings, in which.

Figure 1:
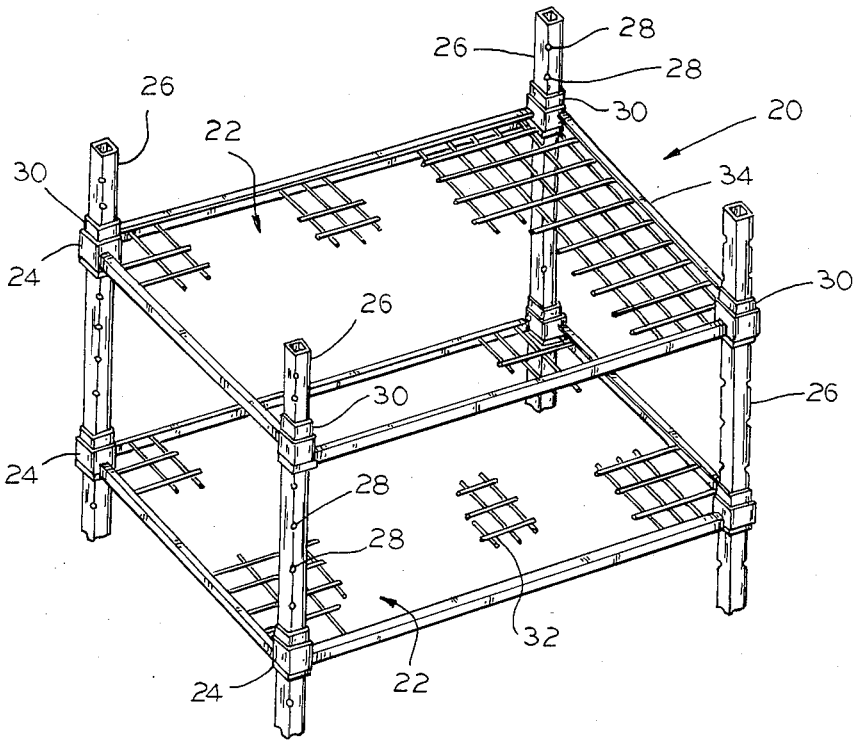
FIG. 1 is a perspective view of an adjustable rack of shelves having a shelf and post combination.

As shown in FIG. 1, a rack of shelves 20, constructed in accordance with the teachings of the above-identified prior applications, comprises at least one flat shelf 22 having four corner sockets 24, corner posts 26 with a graduated, plurality of recurring dimples, recesses, or notches 28 and keepers 30 for maintaining the shelf in a selected position on each post 26. To expedite assembly, a pyramidal cap 27 (FIG. 1A) may be used on the top of each post 26. This cap seals the top and readily guides the socket and keeper parts which fit over the post into place, without catching. On the bottom of each post is a threaded metal or plastic insert (not shown) which seals the bottom and provides a thread for adjusting a leveling bolt to fit non-level floors. Heretofore, shelf 22 has been constructed of a mesh of a metal wires or rods 32 welded together or otherwise secured in any suitable manner to a shelf frame 34.

Figure 1A:
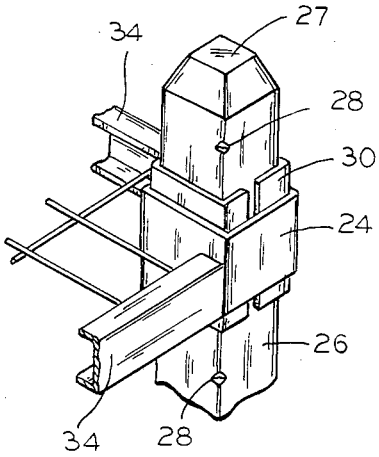
FIG. 1A is a perspective view showing, in greater detail, a corner portion of the adjustable rack of shelves shown in FIG. 1.

As shown in greater detail in FIG. 1A, the corner sockets 24 are welded to the frame 34, for receiving the vertical posts. Each of these sockets has an internal projection with a somewhat truncated pyramidal shape. The bottom end of the socket is tapered outwardly with respect to the top end in order to guide the post 26 into position and to form an effective wedge holding action in cooperation with the keeper 30.

Figure 2:
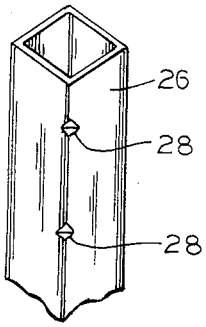
FIG. 2 is a perspective view of a shelf post with notches spaced at regular intervals, such as 1-inch to 1½ inches.

As shown in FIG. 2, the post preferably having a generally rectangular cross section is provided with a plurality of notches 28 spaced at regular intervals of about one to one and one-half inches along the length of at least one edge of the posts 26. These notches receive and accommodate detents 40 located on the interior contour of the keeper.

Figure 3:
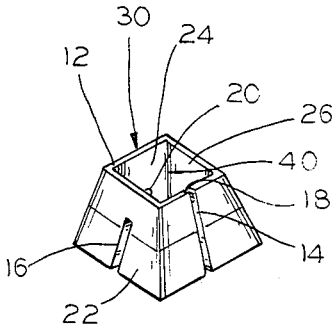
FIG. 3 is a perspective view of a plastic keep used by the invention to lock a shelf in place.

The construction details of on exemplary keeper 30 appear in FIG. 3. As there shown, the keeper comprises a one-piece, truncated, generally pyramid-shaped sleeve which can be placed over the shelf post 26. Keeper 30 has a solid top edge 12, except for a relatively small slot 14 which enables the keeper to spring apart and enlarge its internal cross section as the detents 40 on each internal edge pass into and out of the notches 28 on the post 26. Because the top edge 12 is continuous, except for slot 14, debris will not build up in slots 16–20 which open downwardly through the bottom edges o the sides 22–26 respectively. These slots also help the keeper to flex as the socket presses downwardly. A suitable material of construction for the keeper is nylon.

This invention also makes it possible to economically add any number of supplemental units with only two posts (a savings of two posts per shelf unit). This is accomplished by a use of two inexpensive clips, per shelf, to extend additional units in line or perpendicular to the last unit.

This inventive adjustable shelving rack is not limited to use in a stationary installation. It has the flexibility to be made into a mobile unit by inserting round or square stemmed casters, in lieu of threaded leveling inserts, into the bottom of the post.

The shelf 22 (FIG. 1) is inherently directed to metal since the strength of metal is required for many storage applications. These shelves may be steam cleaned, if made of stainless steel. However, if the metal is a coated material (galvanize, paint, plastic, etc.), they are subject to scratching, chipping, or the like. This leads to an exposure of the base metal with all of the possibilities of rust, corrosion, contamination, and deterioration.

To overcome these and similar problems, the invention uses a plastic shelf 50 (FIG. 4) having the geometry of the shelf 22, in FIG. 1, so that the two shelves 50, 22 may be used interchangeably. Preferably, shelf 50 is molded from a high density polyethylene material or structural foam, with an upper surface which may be either a solid and unbroken sheet or a sheet which has openings 52 formed therein. Convenience of the user is a primary consideration of the design of this surface. If convenience is not material, the consideration is one of weight and strength.

In one preferred embodiment, the invention used Dow HDPE Resin 08054N, which has FDA approval for food contact. The manufacturer describes this resin as follows:

| PHYSICAL PROPERTIES[1,2] | | ENGLISH UNITS | SI UNITS | ASTM METHOD |
|---|---|---|---|---|
| General: | Melt Index (190° C./2160 gm) | 8.0 gm/10 min | 8.0 gm/10 min | D-1238 |
| | Melt Flow Ratio ($I_{10}/I_2$) | 6.8 | 6.8 | D-1238 |
| | Annealed Density | .964 gm/ml | .964 gm/ml | D-792 |
| Thermal: | Vicat Softening Point | 263° F. | 128° C. | D-1525 |
| | Brittleness Temperature | < −105° F. | < −76° C. | D-746 |

[1]Typical values, not to be construed as specifications.
[2]All tests performed on compression molded samples.

This narrow molecular weight distribution homopolymer offers an excellent impact strength and stiffness with good stress crack resistance. Dow HDPE 08054N has good processability over a wide range of molding conditions.

In another embodiment, structural molded foam is used to form the shelves. An inert gas, such as nitrogen, is mixed with resin during the melting process used to mold the shelf. As the resin liquefies, the gas expands and as the resin cools, the gas contracts causing cellular structures to form in the molded shelf. This results in a molded shelf with a solid skin or outer surface and a cellular core, which yields a structure having a high strength to weight ratio.

Figure 4:
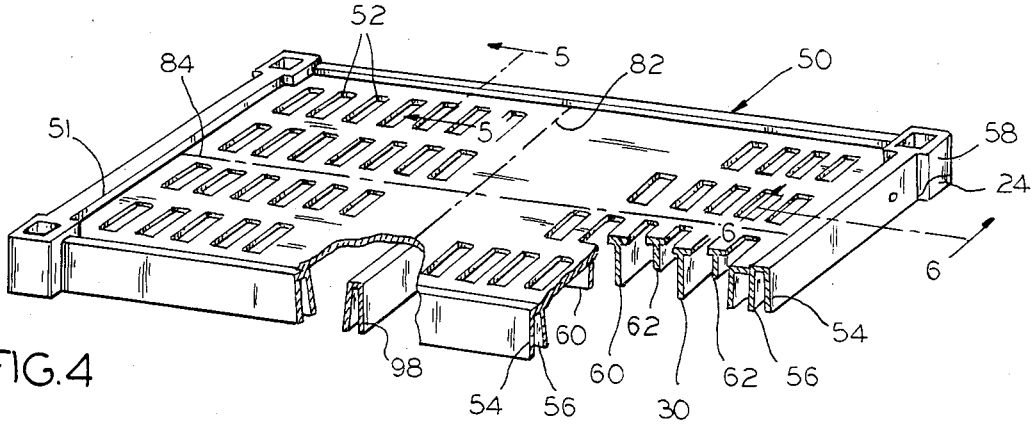
FIG. 4 is a perspective view (partly broken away) of an embodiment showing a plastic shelf.

As shown in FIG. 4, a channel 54 extends around the underside of a perimeter of the shelf to receive a reinforcing metal frame 56. This frame is substantially the same as frame 34 of FIG. 1A, which includes side rails 34 welded to corner socket 24. The plastic shelf 50 has a relatively large socket 58 formed therein to receive and snugly embrace the metal socket 24.

As shown in FIG. 4, plastic sockets 58 are molded into the corners of shelf 50 in order to receive a metal socket and post at each corner.

As shown in FIG. 1, a channel 98 is provided on the underside of shelf 50 intermediate the ends of the shelf. The channel 98 may extend straight across the shelf, to intermediate channels may be provided in a criss-cross pattern, or a single intermediate channel or plurality of intermediate channels may be provided at any desired orientation to meet any variety of design parameters.

In another embodiment (not shown), individual metal bars or members are used to reinforce plastic shelf 50. The individual members are received by channel 54, but are not connected to one another. In this embodiment, individual metal sockets 24 are fitted within sockets 58 of plastic shelf 50.

The underside of the shelf 50 is molded with vertical, or orthogonally oriented fins 60, which can be tapered in shape, to impart added strength to the shelf to support objects resting on the shelf. In one embodiment these fins were alternated with shorter fins 62 since that way an adequate strength is provided with a lighter weight and with a resulting savings of material.

Figure 9:
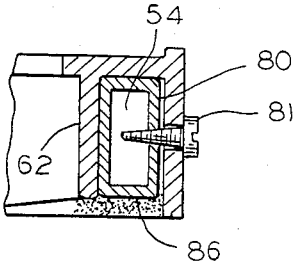
FIG. 9 is a cross sectional view of a third embodiment taken along line 5—5 of FIG. 4.

The metal frame 56 may have any convenient configuration. In one embodiment (FIG. 9), the frame 56 is formed from closed box side rails 80 which occupy the entire channel 54 to preclude entry of foreign matter. The shape of side rails 80 can be either rectangular or square. This embodiment is desired when a maximum strength is necessary or desirable.

Figure 5:
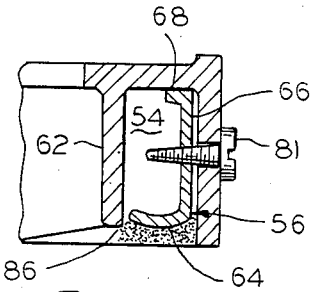
FIG. 5 is a cross section of a first embodiment taken along line 5—5 of FIG. 4.
Figure 6:
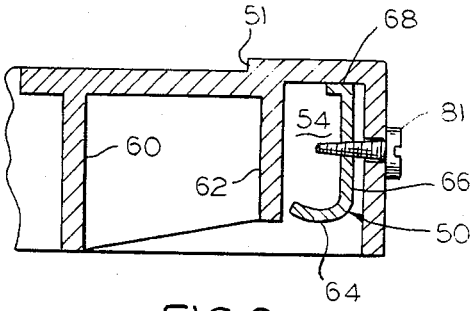
FIG. 6 is a cross section of the first embodiment taken along line 6—6 of FIG. 4.

In another embodiment (FIGS. 5, 6), each of the side rails 56 has a generally C-shaped cross section. Preferably, the lower or transverse flange 64 of said C-shape is wide enough to seal off the entire entrance to channel 54, thereby barring entry of foreign matter into the channel 54. The vertical flange 66 may have any suitable height that may be necessary to provide the desired mechanical strength. The width of the upper or transverse flange 68 is also determined by the mechanical strength required for the total structure.

Figure 7:
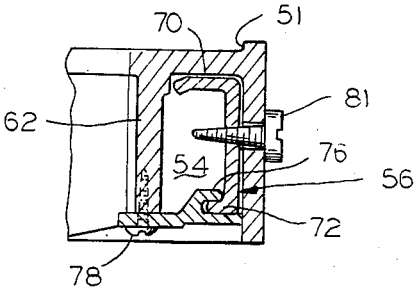
FIG. 7 is a cross section of a second embodiment taken along line 5—5 of FIG. 4.
Figure 8:
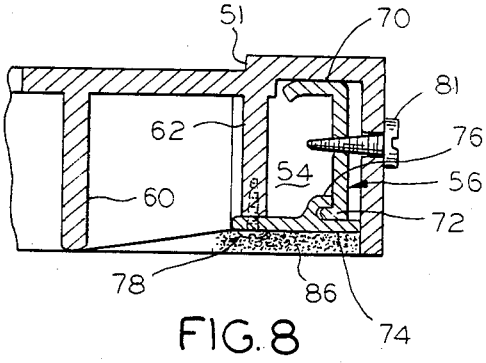
FIG. 8 is a cross section of the second embodiment taken along line 6—6 of FIG. 4.

In the embodiment of FIGS. 7, 8, it is assumed that the mechanical strength requirements are such that the upper or transverse flange 70 should be wider than flange 68, and that any material savings may be realized by providing a narrow lower or transverse flange 72. However, such a narrow flange 72 leaves an open space which, if uncorrected, would provide a cavity entrance that might lead to contamination, shelter for insects, or the like.

To preclude such contamination problems, the invention provides cover plates 74 for closing the entrance to channel 54 that is formed in the plastic. The top of plate 74 has a longitudinal strip 76 extending along the length thereof to hook over lower flange 72 of the side rail 54. The cover plates 74 are secured in place by screws 78 which periodically join the plates 74 to the plastic shelf, or any other suitable fastener means, such s pop-in rivets. In some applications, it may be desirable to eliminate the need for such fasteners and adapt the cover plate 74 and shelf 50 so that the cover plate 74 will snap into place in channel 54. The cover plates are preferably made of plastic.

In other embodiments (not shown), side rails 56 can be H-shaped, I-shaped, U-shaped, S-shaped, T-shaped or L-shaped.

In each of the embodiments, one or more screws 81 may be added to hold the side rail 56 in place. Channels 54 can be molded to provide internal ribs or detents to engage the metal reinforcing so that the metal reinforcing members or frame snap into place without the need for screws 81.

The principle of the invention may be expanded by adding any suitable number of support members or rails intermediate the ends of the metal reinforcing members disposed in channels 54 or of the metal frame 56, as indicated by dot-dashed lines 82, 84 (FIG. 4). The support members may be oriented in any suitable manner (diagonally across the shelf or straight across the width or length of the shelf). For example, these added support members may be welded or otherwise attached to the side rails 56 before being inserted into the molded plastic shelf and fitted into channels similar to 54 which are molded into the plastic shelves. The support members may also be molded into the shelf by means of insert molding.

To further preserve and protect the metal from the environment, and the environment from the metal, a sealant 86 (FIGS. 5, 8, 9) may be added to completely encase the metal frame 56. This sealant may be a plastisol or an elastomer which is approved for use in contact with food which may be consumed by a human. It may be applied as a hot melt or sprayed on; or, it may be applied in any other suitable manner.

Figure 10:
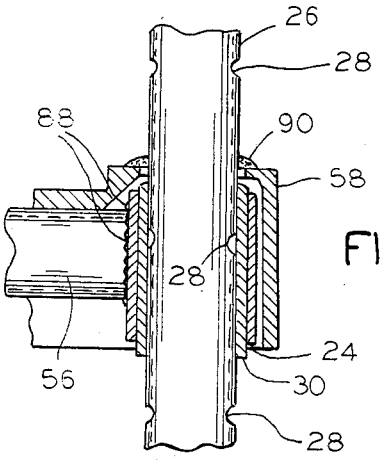
FIG. 10 is a cross section of the shelf showing a corner post in place, within a corner socket on the shelf.

FIG. 10 explains the installation of the shelves and the operation of the parts. First, the keeper 30 is slipped over the corner post 26 and slid along the post until detent 40 fits into a selected notch 28. Then the plastic socket 58 on the shelf is fitted over the corner post, with the metal socket 24 in place inside socket 58. The metal socket 24 is welded at 88 to the side rails 56. At this time the plastic socket 58 molded into the plastic shelf surrounds and practically covers both the keeper 30 and the metal socket 24. Next, a cap 90 is slipped over the post 26 and slid down into abutment with the top of plastic socket 58, in order to close any crack between post 26 and plastic socket 58.

The advantages of the invention are that it provides a shelving system that is lightweight, resistant to rust and attack by chemical substances and comparable in strength to steel shelving. Moreover, if the spilled material should run off the edge of the shelf, the metal frame 56 is buried deeply enough within the lower side of the plastic to keep it being being attacked. In fact, a lip 51 can be provided around the perimeter of the shelf to prevent spilled material from running over the edge of the shelf. If the environment is especially hazardous, the cover plate, and perhaps sealant, further protects the metal frame.

Those who are skilled in the art will readily perceive how to modify the invention. Therefore, the appended claims are to be construed to cover all equivalent structures which fall within the true scope and spirit of the invention.

What is claimed is:

1. A shelf for a rack of shelves which are supported by at least two corner posts, each of said corner posts provided with a plurality of recesses spaced at intervals along the length of said posts, a plurality of sleeves for receiving said corner posts, each of said sleeves having an internal passageway complementary in shape to said corner posts whereby said sleeves may slide longitudinally along said posts, detent means formed on the inside of said passageway of each of said sleeves for cooperating with said recesses whereby said sleeves may be held in place on said posts by said detent means fitting into a selected one of said recesses, comprising a molded or formed all plastic shelf having a surface and having at least one peripheral open channel formed therein and on the underside therof, said channel opening to the exterior of the shelf surface, plastic sockets molded into at least two corners of said shelf for receiving said corner posts, metal reinforcing members inserted within said channel through said channel opening, a plurality of metal sockets disposed in said plastic sockets for receiving and capturing said sleeves when said sleeves are held in place on said posts.

2. The shelf of claim 1 wherein said metal reinforcing members comprise a metal frame formed from a plurality of side rails joined at their ends to said metal sockets, said rails shaped and dimensioned to fit into said channels.

3. The shelf of claim 2 wherein said side rail includes a transverse flange disposed along the bottom of said rail and positioned to extend across almost all of the opening in said channel thus tending to seal the channel against any entry of foreign matter.

4. The shelf of claim 3 wherein said side rail has a somewhat C-shaped cross section and said transverse flange is the lower portion of said C-shape.

5. The shelf of claim 2 wherein said side rail has a somewhat C-shaped cross-section, the bottom flange of said C-shaped cross-section being less than the width of said opening, a cover plate extending along a width and length of said channel to cover and close said channel, said cover plate hving a thin strip of plastic integrally formed thereon to slip over and thus attach to said flange, said fastener means for holding said cover plate in place.

6. The shelf of claim 2 wherein said side rail has a box shaped cross-section which substantially fills the channel.

7. The shelf of claim 2 and a sealant covering said frame and extending across said peripheral channel for sealing said metal frame in said channel, whereby chemicals spilled on said shelf do not attack said frame.

8. The shelf of claim 2 and a cap shaped to fit around said post and adapted to rest on top of and in close abutment with said molded plastic socket for covering and closing any crack between said sockets and a corner post.

9. The shelf of claim 1 wherein at least one intermediate support member extends across the underside of the shelf intermediate the ends of the metal reinforcing members, and a channel is formed in said plastic shelf for said intermediate support member to fit into.

10. The shelf of claim 1 wherein a plurality of vertical fins from an underside of said shelf to add vertical supporting strength to said shelf.

11. The shelf of claim 10 including an upper surface wherein openings are formed in said upper surface through said shelf between said vertical fins.

12. The shelf of claim 1 wherein said shelf has a solid upper surface.

13. The shelf of claim 12 wherein said shelf has a raised upwrdly extending lip around the perimeter of the upper surface of the shelf.

14. The shelf of claim 1 wherein said shelf has openings formed therein.

15. A shelving system of all plastic shelves having corners with corner post receiving sockets formed therein; corner posts with a plurality of capture means formed periodically along the length thereof for engaging and securing said shelf in place at a desired position on said posts; keeper means for mating with said capture means and adapted to fit around said corner posts and to engage said shelves and to secure the shelves in place on said posts at selected ones of said capture means; comprising a plurality of shelves being made of molded or formed plastic, each of said shelves having at least one channel extending peripherally along the edge of said shelf and terminating in said corner sockets which are attached to said shelf; a metal frame having side rails disposed in said channel; and a plurality of metal sockets attached to said side rails and disposed in said molded or formed corner sockets, the metal sockets of said metal frame being shaped and dimensioned to receive and hold said keeper.

16. The system of claim 15 and at least one cover plate for closing said channel after said frame is fitted therein in order to prevent entry of foreign matter into said channel.

17. The system of claim 15 and sealant means for sealing said metal frame into said channel.

18. The system of claim 15 and vertical fins which are integrally formed on the bottom of said shelf and depend downward from said shelf to give added strength.

19. The system of claim 15 and a cap shaped to fit around said post and adapted to rest on top of said plastic socket molded into said shelf for sealing any crack between said plastic socket and said corner post.

20. A shelf for a rack of shelves which are supported by at least two corner posts, each of said corner posts provided with a plurality of capture means formed periodically along the length thereof for engaging and securing said shelf in place at a desired position on said posts, a plurality of keeper means for mating with said capture means and adapted to fit around said corner posts to secure said shelves in place on said posts, comprising a molded or formed all-plastic shelf having a surface and having at least one open peripheral channel formed therein and on the underside thereon, said channels opening to the exterior of the shelf surface, plastic sockets molded or formed into at least two corners of said shelf, metal reinforcing members inserted within said channel, said members comprising a metal frame formed from a plurality of side rails each of which includes a transverse flange disposed along the bottom of said rail and positioned to extend across the opening in said channel thus tending to seal the channel against any entry of foreign matter, and a plurality of metal sockets disposed in said plastic sockets for receiving and holding said keepers when said keepers are mated with said capture means.

21. The shelf of claim 20 wherein said side rails has a somewhat C-shaped cross section and said transverse flange is the lower portion of said C-shape.

22. The shelf of claim 20 wherein said side rail has a somewhat C-shaped cross-section, the bottom flange of said C-shaped cross-section being less than the width of said opening, a cover plate extending along a width and length of said channel to cover and close said channel, said cover plate having a thin strip of plastic integrally formed thereon to slip over and thus attach to said flange, and fastener means for holding said cover plate in place.

* * * * *